US009595262B2

(12) United States Patent
Markovic et al.

(10) Patent No.: US 9,595,262 B2
(45) Date of Patent: Mar. 14, 2017

(54) LINEAR PREDICTION BASED CODING SCHEME USING SPECTRAL DOMAIN NOISE SHAPING

(71) Applicant: Fraunhofer-Gesellschaft zur Foerderung der angewandten Forschung e.V., Munich (DE)

(72) Inventors: Goran Markovic, Nuremberg (DE); Guillaume Fuchs, Erlangen (DE); Nikolaus Rettelbach, Nuremberg (DE); Christian Helmrich, Erlangen (DE); Benjamin Schubert, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 438 days.

(21) Appl. No.: 13/966,601

(22) Filed: Aug. 14, 2013

(65) Prior Publication Data

US 2013/0332153 A1 Dec. 12, 2013

Related U.S. Application Data

(63) Continuation of application No. PCT/EP2012/052455, filed on Feb. 14, 2012.
(Continued)

(51) Int. Cl.
*G10L 19/00* (2013.01)
*G10L 19/012* (2013.01)
(Continued)

(52) U.S. Cl.
CPC ..... *G10L 19/00* (2013.01); *G10K 11/16* (2013.01); *G10L 19/005* (2013.01);
(Continued)

(58) Field of Classification Search
CPC ..... G10L 19/24; G10L 21/0208; G10L 25/90; G10L 19/0017; G10L 19/0204;
(Continued)

(56) References Cited

U.S. PATENT DOCUMENTS 5,598,506 A 1/1997 Wigren et al.
5,606,642 A 2/1997 Stautner et al.
(Continued)

FOREIGN PATENT DOCUMENTS

AU 2007/312667 4/2008
CA 2730239 A1 1/2010
(Continued)

OTHER PUBLICATIONS

Britanak et al. "A new fast algorithm for the unified forward and inverse MDCT/MDST computation", Signal Processing vol. 82, Issue 3, Mar. 2002, pp. 433-459.*
(Continued)

*Primary Examiner* — Huyen Vo
(74) *Attorney, Agent, or Firm* — Michael A. Glenn; Perkins Coie LLP

(57) ABSTRACT

An encoding concept which is linear prediction based and uses spectral domain noise shaping is rendered less complex at a comparable coding efficiency in terms of, for example, rate/distortion ratio, by using the spectral decomposition of the audio input signal into a spectrogram having a sequence of spectra for both linear prediction coefficient computation as well as spectral domain shaping based on the linear prediction coefficients. The coding efficiency may remain even if such a lapped transform is used for the spectral decomposition which causes aliasing and necessitates time aliasing cancellation such as critically sampled lapped transforms such as an MDCT.

13 Claims, 4 Drawing Sheets

Related U.S. Application Data

(60) Provisional application No. 61/442,632, filed on Feb. 14, 2011.

(51) Int. Cl.

| | |
|---|---|
| ***G10K 11/16*** | (2006.01) |
| ***G10L 19/005*** | (2013.01) |
| ***G10L 19/12*** | (2013.01) |
| ***G10L 19/03*** | (2013.01) |
| ***G10L 19/22*** | (2013.01) |
| ***G10L 21/0216*** | (2013.01) |
| ***G10L 25/78*** | (2013.01) |
| *G10L 19/26* | (2013.01) |
| *G10L 19/04* | (2013.01) |
| *G10L 19/02* | (2013.01) |
| *G10L 25/06* | (2013.01) |
| *G10L 19/025* | (2013.01) |
| *G10L 19/107* | (2013.01) |

(52) U.S. Cl.

CPC ..... *G10L 19/012* (2013.01); *G10L 19/03* (2013.01); *G10L 19/12* (2013.01); *G10L 19/22* (2013.01); *G10L 21/0216* (2013.01); *G10L 25/78* (2013.01); *G10L 19/025* (2013.01); *G10L 19/0212* (2013.01); *G10L 19/04* (2013.01); *G10L 19/107* (2013.01); *G10L 19/26* (2013.01); *G10L 25/06* (2013.01)

(58) Field of Classification Search

CPC ..... G10L 15/02; G10L 19/005; G10L 19/03; G10L 19/167; G10L 25/69; G10L 25/78; G10L 15/142; G10L 15/187; G10L 19/04; G10L 19/06; G10L 19/0212; G10L 19/26; G10L 19/02; G10L 19/0208; G10L 19/032; G10L 25/12; G10L 25/18

USPC ..... 704/200, 500–504, 203–206, 216–220, 704/230

See application file for complete search history.

(56) References Cited

U.S. PATENT DOCUMENTS 5,684,920 A * 11/1997 Iwakami ..... G10L 19/0204 704/201
5,727,119 A 3/1998 Davidson et al.
5,848,391 A 12/1998 Bosi et al.
5,890,106 A 3/1999 Bosi-Goldberg et al.
5,953,698 A 9/1999 Hayata
5,960,389 A 9/1999 Jarvinen et al.
6,070,137 A 5/2000 Bloebaum et al.
6,134,518 A 10/2000 Cohen et al.
6,173,257 B1 1/2001 Gao
6,236,960 B1 5/2001 Peng et al.
6,587,817 B1 7/2003 Vähätalo et al.
6,636,829 B1 10/2003 Benyassine et al.
6,636,830 B1 10/2003 Princen et al.
6,680,972 B1 1/2004 Liljeryd et al.
6,879,955 B2 4/2005 Rao et al.
6,969,309 B2 11/2005 Carpenter
6,980,143 B2 12/2005 Linzmeier et al.
7,003,448 B1 2/2006 Lauber et al.
7,249,014 B2 7/2007 Kannan et al.
7,280,959 B2 10/2007 Bessette
7,343,283 B2 3/2008 Ashley et al.
7,363,218 B2 4/2008 Jabri et al.
7,565,286 B2 7/2009 Gracie et al.
7,587,312 B2 9/2009 Kim
7,627,469 B2 12/2009 Nettre et al.
7,707,034 B2 4/2010 Sun et al.
7,711,563 B2 5/2010 Chen
7,788,105 B2 8/2010 Miseki
7,801,735 B2 9/2010 Thumpudi et al.
7,809,556 B2 10/2010 Goto et al.
7,860,720 B2 12/2010 Thumpudi et al.
7,877,253 B2 1/2011 Krishnan et al.
7,917,369 B2 3/2011 Lee et al.
7,930,171 B2 4/2011 Chen et al.
7,933,769 B2 4/2011 Bessette
7,979,271 B2 7/2011 Bessette
7,987,089 B2 7/2011 Krishnan et al.
8,045,572 B1 10/2011 Li et al.
8,078,458 B2 12/2011 Zopf et al.
8,121,831 B2 2/2012 Oh et al.
8,160,274 B2 4/2012 Bongiovi et al.
8,239,192 B2 8/2012 Kovesi et al.
8,255,207 B2 8/2012 Vaillancourt et al.
8,255,213 B2 8/2012 Yoshida et al.
8,363,960 B2 1/2013 Petersohn et al.
8,364,472 B2 1/2013 Ehara
8,428,936 B2 4/2013 Mittal et al.
8,428,941 B2 4/2013 Boehm et al.
8,452,884 B2 5/2013 Wang et al.
8,566,106 B2 10/2013 Salami et al.
8,630,862 B2 1/2014 Geiger et al.
8,630,863 B2 1/2014 Son et al.
8,635,357 B2 1/2014 Ebersviller
8,825,496 B2 9/2014 Setiawan et al.
8,954,321 B1 2/2015 Beack et al.
2002/0111799 A1 8/2002 Bernard
2002/0176353 A1 11/2002 Atlas et al.
2002/0184009 A1 12/2002 Heikkinen
2003/0009325 A1 1/2003 Kirchherr et al.
2003/0033136 A1 2/2003 Lee
2003/0046067 A1 3/2003 Gradl
2003/0078771 A1 4/2003 Jung et al.
2003/0225576 A1 12/2003 Li et al.
2004/0010329 A1 1/2004 Lee et al.
2004/0093204 A1 5/2004 Byun et al.
2004/0093368 A1 5/2004 Lee et al.
2004/0184537 A1 9/2004 Geiger et al.
2004/0193410 A1 9/2004 Lee et al.
2004/0220805 A1 11/2004 Geiger et al.
2005/0021338 A1 1/2005 Graboi et al.
2005/0065785 A1 3/2005 Bessette
2005/0080617 A1 4/2005 Koshy et al.
2005/0091044 A1 4/2005 Ramo et al.
2005/0096901 A1 5/2005 Uvliden et al.
2005/0130321 A1 6/2005 Nicholson et al.
2005/0165603 A1 7/2005 Bessette et al.
2005/0192798 A1 9/2005 Vainio et al.
2005/0240399 A1 10/2005 Makinen et al.
2005/0278171 A1 12/2005 Suppappola et al.
2006/0095253 A1 5/2006 Schuller et al.
2006/0115171 A1 6/2006 Geiger et al.
2006/0116872 A1 6/2006 Byun et al.
2006/0173675 A1 8/2006 Ojanpera et al.
2006/0206334 A1 9/2006 Kapoor et al.
2006/0210180 A1 9/2006 Geiger et al.
2006/0293885 A1 12/2006 Gournay et al.
2007/0050189 A1 3/2007 Cruz-Zeno et al.
2007/0100607 A1 5/2007 Villemoes
2007/0147518 A1 6/2007 Bessette et al.
2007/0160218 A1 7/2007 Jakka et al.
2007/0171931 A1 7/2007 Manjunath et al.
2007/0174047 A1 7/2007 Anderson et al.
2007/0196022 A1 8/2007 Geiger et al.
2007/0225971 A1 9/2007 Bessette et al.
2007/0282603 A1 12/2007 Bessette
2008/0010064 A1 1/2008 Takeuchi et al.
2008/0015852 A1 1/2008 Kruger et al.
2008/0027719 A1 1/2008 Kirshnan et al.
2008/0046236 A1 2/2008 Thyssen et al.
2008/0052068 A1 2/2008 Aguilar et al.
2008/0097764 A1 4/2008 Grill et al.
2008/0120116 A1 5/2008 Schnell et al.
2008/0147415 A1 6/2008 Schnell et al.
2008/0208599 A1 8/2008 Rosec et al.
2008/0221905 A1 9/2008 Schnell et al.
2008/0249765 A1 10/2008 Schuijers et al.
2008/0275580 A1 11/2008 Andersen

(56) References Cited

U.S. PATENT DOCUMENTS

| | | | |
|---|---|---|---|
| 2009/0024397 | A1 | 1/2009 | Ryu et al. |
| 2009/0076807 | A1 | 3/2009 | Xu et al. |
| 2009/0110208 | A1 | 4/2009 | Choo et al. |
| 2009/0204412 | A1 | 8/2009 | Kovesi et al. |
| 2009/0226016 | A1 | 9/2009 | Fitz et al. |
| 2009/0228285 | A1 | 9/2009 | Schnell et al. |
| 2009/0319283 | A1 | 12/2009 | Schnell et al. |
| 2009/0326930 | A1 | 12/2009 | Kawashima et al. |
| 2009/0326931 | A1 | 12/2009 | Ragot et al. |
| 2010/0017200 | A1 | 1/2010 | Oshikiri et al. |
| 2010/0017213 | A1 | 1/2010 | Edler et al. |
| 2010/0049511 | A1 | 2/2010 | Ma et al. |
| 2010/0063811 | A1 | 3/2010 | Gao et al. |
| 2010/0063812 | A1 | 3/2010 | Gao |
| 2010/0070270 | A1 | 3/2010 | Gao |
| 2010/0106496 | A1 | 4/2010 | Morii et al. |
| 2010/0138218 | A1 | 6/2010 | Geiger et al. |
| 2010/0198586 | A1 | 8/2010 | Edler et al. |
| 2010/0217607 | A1 | 8/2010 | Neuendorf et al. |
| 2010/0262420 | A1 | 10/2010 | Herre et al. |
| 2010/0268542 | A1 | 10/2010 | Kim et al. |
| 2011/0002393 | A1 | 1/2011 | Suzuki et al. |
| 2011/0007827 | A1 | 1/2011 | Virette et al. |
| 2011/0106542 | A1 | 5/2011 | Bayer et al. |
| 2011/0153333 | A1 | 6/2011 | Bessette |
| 2011/0173010 | A1 | 7/2011 | Lecomte et al. |
| 2011/0173011 | A1 | 7/2011 | Geiger et al. |
| 2011/0178795 | A1 | 7/2011 | Bayer et al. |
| 2011/0218797 | A1 | 9/2011 | Mittal et al. |
| 2011/0218799 | A1 | 9/2011 | Mittal et al. |
| 2011/0218801 | A1 | 9/2011 | Vary et al. |
| 2011/0257979 | A1 | 10/2011 | Gao |
| 2011/0270616 | A1* | 11/2011 | Garudadri ..... G10L 19/02 704/500 |
| 2011/0311058 | A1 | 12/2011 | Oh et al. |
| 2012/0226505 | A1 | 9/2012 | Lin et al. |
| 2012/0228810 | A1 | 9/2012 | Huang et al. |
| 2012/0271644 | A1 | 10/2012 | Bessette et al. |
| 2013/0332151 | A1 | 12/2013 | Fuchs et al. |
| 2014/0257824 | A1 | 9/2014 | Taleb et al. |

FOREIGN PATENT DOCUMENTS

| | | | |
|---|---|---|---|
| CN | 1274456 | A | 11/2000 |
| CN | 1344067 | A | 4/2002 |
| CN | 1381956 | A | 11/2002 |
| CN | 1437747 | A | 8/2003 |
| CN | 1539137 | A | 10/2004 |
| CN | 1539138 | A | 10/2004 |
| CN | 101351840 | | 10/2006 |
| CN | 101110214 | A | 1/2008 |
| CN | 101366077 | A | 2/2009 |
| CN | 101371295 | A | 2/2009 |
| CN | 101379551 | A | 3/2009 |
| CN | 101388210 | A | 3/2009 |
| CN | 101425292 | A | 5/2009 |
| CN | 101483043 | A | 7/2009 |
| CN | 101488344 | A | 7/2009 |
| CN | 101743587 | | 6/2010 |
| CN | 101770775 | A | 7/2010 |
| DE | 102008015702 | A1 | 8/2009 |
| EP | 0665530 | A1 | 8/1995 |
| EP | 0673566 | A1 | 9/1995 |
| EP | 0758123 | A2 | 2/1997 |
| EP | 0784846 | A1 | 7/1997 |
| EP | 0843301 | B1 | 5/1998 |
| EP | 1120775 | A1 | 8/2001 |
| EP | 1852851 | | 7/2007 |
| EP | 1845520 | A1 | 10/2007 |
| EP | 2107556 | | 7/2009 |
| EP | 2109098 | A2 | 10/2009 |
| EP | 2144230 | A1 | 1/2010 |
| FR | 2911228 | A1 | 7/2008 |
| JP | H08263098 | A | 10/1996 |
| JP | 10039898 | A | 2/1998 |
| JP | H10214100 | A | 8/1998 |
| JP | H11502318 | A | 2/1999 |
| JP | H1198090 | A | 4/1999 |
| JP | 2000357000 | A | 12/2000 |
| JP | 2002-118517 | | 4/2002 |
| JP | 2003501925 | A | 1/2003 |
| JP | 2003506764 | A | 2/2003 |
| JP | 2004513381 | A | 4/2004 |
| JP | 2004514182 | A | 5/2004 |
| JP | 2005534950 | A | 11/2005 |
| JP | 2006504123 | A | 2/2006 |
| JP | 2007065636 | A | 3/2007 |
| JP | 2007523388 | A | 8/2007 |
| JP | 2007525707 | A | 9/2007 |
| JP | 2007538282 | A | 12/2007 |
| JP | 2008-15281 | | 1/2008 |
| JP | 2008513822 | A | 5/2008 |
| JP | 2008261904 | A | 10/2008 |
| JP | 2009508146 | A | 2/2009 |
| JP | 2009075536 | A | 4/2009 |
| JP | 2009522588 | A | 6/2009 |
| JP | 2009-527773 | | 7/2009 |
| JP | 2010530084 | A | 9/2010 |
| JP | 2010-538314 | | 12/2010 |
| JP | 2010539528 | A | 12/2010 |
| JP | 2011501511 | A | 1/2011 |
| JP | 2011527444 | A | 10/2011 |
| KR | 1020040043278 | A | 5/2004 |
| KR | 1020060025203 | A | 3/2006 |
| KR | 1020070088276 | A | 8/2007 |
| KR | 20080032160 | A | 4/2008 |
| KR | 1020100059726 | A | 6/2010 |
| KR | 1020100134709 | | 4/2015 |
| RU | 2169992 | C2 | 6/2001 |
| RU | 2183034 | | 5/2002 |
| RU | 2003118444 | A | 12/2004 |
| RU | 2004138289 | A | 6/2005 |
| RU | 2296377 | C2 | 3/2007 |
| RU | 2302665 | C2 | 7/2007 |
| RU | 2312405 | C2 | 12/2007 |
| RU | 2331933 | C2 | 8/2008 |
| RU | 2335809 | C2 | 10/2008 |
| RU | 2008126699 | A | 2/2010 |
| RU | 2009107161 | A | 9/2010 |
| RU | 2009118384 | A | 11/2010 |
| TW | 200830277 | | 10/1996 |
| TW | 200943279 | | 10/1998 |
| TW | 201032218 | | 9/1999 |
| TW | I 320172 | | 2/2010 |
| TW | 201009812 | A | 3/2010 |
| TW | 201040943 | | 11/2010 |
| TW | 201103009 | | 1/2011 |
| WO | 92/22891 | A1 | 12/1992 |
| WO | 95/10890 | A1 | 4/1995 |
| WO | 95/30222 | A1 | 11/1995 |
| WO | 96/29696 | A1 | 9/1996 |
| WO | 00/31719 | A2 | 6/2000 |
| WO | 0075919 | A1 | 12/2000 |
| WO | 02/101724 | A1 | 12/2002 |
| WO | WO-02101722 | | 12/2002 |
| WO | 2005041169 | A2 | 5/2005 |
| WO | 2005078706 | A1 | 8/2005 |
| WO | 2005081231 | A1 | 9/2005 |
| WO | 2005112003 | A1 | 11/2005 |
| WO | 2006082636 | A1 | 8/2006 |
| WO | WO-2007051548 | | 5/2007 |
| WO | WO-2007073604 | | 7/2007 |
| WO | WO2007/096552 | | 8/2007 |
| WO | WO-2008/013788 | | 10/2008 |
| WO | WO-2008013788 | | 10/2008 |
| WO | 2008/157296 | A1 | 12/2008 |
| WO | WO-2009029032 | | 3/2009 |
| WO | 2009077321 | A3 | 10/2009 |
| WO | 2009121499 | A1 | 10/2009 |
| WO | 2010/003563 | A1 | 1/2010 |
| WO | 2010003491 | A1 | 1/2010 |
| WO | WO-2010/003491 | | 1/2010 |
| WO | WO-2010040522 | | 4/2010 |

(56) References Cited

FOREIGN PATENT DOCUMENTS

| | | | |
|---|---|---|---|
| WO | 2010059374 | A1 | 5/2010 |
| WO | 2010/081892 | A2 | 7/2010 |
| WO | 2011/006369 | A1 | 1/2011 |
| WO | WO-2010003532 | | 2/2011 |
| WO | 2011/048117 | A1 | 4/2011 |
| WO | WO-2011048094 | | 4/2011 |
| WO | 2011/147950 | A1 | 12/2011 |

OTHER PUBLICATIONS

"Digital Cellular Telecommunications System (Phase 2+); Universal Mobile Telecommunications System (UMTS); LTE; Speech codec speech processing functions; Adaptive Multi-Rate-Wideband (AMR-)WB Speech Codec; Transcoding Functions (3GPP TS 26.190 version 9.0.0", Technical Specification, European Telecommunications Standards Institute (ETSI) 650, Route Des Lucioles; F-06921 Sophia-Antipolis; France; No. V.9.0.0, Jan. 1, 2012, 54 Pages.

"IEEE Signal Processing Letters", IEEE Signal Processing Society. vol. 15. ISSN 1070-9908., 2008, 9 Pages.

"Information Technology—MPEG Audio Technologies—Part 3: Unified Speech and Audio Coding", ISO/IEC JTC 1/SC 29 ISO/IEC DIS 23003-3, Feb. 9, 2011, 233 Pages.

"WD7 of USAC", International Organisation for Standardisation Organisation Internationale De Normailisation. ISO/IEC JTC1/SC29/WG11. Coding of Moving Pictures and Audio. Dresden, Germany., Apr. 2010, 148 Pages.

3GPP, "3rd Generation Partnership Project; Technical Specification Group Service and System Aspects. Audio Codec Processing Functions. Extended AMR Wideband Codec; Transcoding functions (Release 6).", 3GPP Draft; 26.290, V2.0.0 3rd Generation Partnership Project (3GPP), Mobile Competence Centre; Valbonne, France., Sep. 2004, pp. 1-85.

Ashley, J et al., "Wideband Coding of Speech Using a Scalable Pulse Codebook", 2000 IEEE Speech Coding Proceedings., Sep. 17, 2000, pp. 148-150.

Bessette, B et al., "The Adaptive Multirate Wideband Speech Codec (AMR-WB)", IEEE Transactions on Speech and Audio Processing, IEEE Service Center. New York. vol. 10, No. 8., Nov. 1, 2002, pp. 620-636.

Bessette, B et al., "Universal Speech/Audio Coding Using Hybrid ACELP/TCX Techniques", ICASSP 2005 Proceedings. IEEE International Conference on Acoustics, Speech, and Signal Processing, vol. 3 Jan. 2005, pp. 301-304.

Bessette, B et al., "Wideband Speech and Audio Codec at 16/24/32 Kbit/S Using Hybrid Acelp/Tcx Techniques", 1999 IEEE Speech Coding Proceedings. Porvoo, Finland., Jun. 20, 1999, pp. 7-9.

Ferreira, A et al., "Combined Spectral Envelope Normalization and Subtraction of Sinusoidal Components in the ODFT and MDCT Frequency Domains", 2001 IEEE Workshop on Applications of Signal Processing to Audio and Acoustics., Oct. 2001, pp. 51-54.

Fischer, et al., "Enumeration Encoding and Decoding Algorithms for Pyramid Cubic Lattice and Trellis Codes", IEEE Transactions on Information Theory. IEEE Press, USA, vol. 41, No. 6, Part 2., Nov. 1, 1995, pp. 2056-2061.

Hermansky, H et al., "Perceptual linear predictive (PLP) analysis of speech", J. Acoust. Soc. Amer. 87 (4)., Apr. 1990, pp. 1738-1751.

Hofbauer, K et al., "Estimating Frequency and Amplitude of Sinusoids in Harmonic Signals—A Survey and the Use of Shifted Fourier Transforms", Graz: Graz University of Technology; Graz University of Music and Dramatic Arts; Diploma Thesis, Apr. 2004, 111 pages.

Lanciani, C et al., "Subband-Domain Filtering of MPEG Audio Signals", 1999 IEEE International Conference on Acoustics, Speech, and Signal AZ, USA., Mar. 15, 1999, pp. 917-920.

Lauber, P et al., "Error Concealment for Compressed Digital Audio", Presented at the 111th AES Convention. Paper 5460. New York, USA., Sep. 21, 2001, 12 Pages.

Lee, Ick Don et al., "A Voice Activity Detection Algorithm for Communication Systems with Dynamically Varying Background Acoustic Noise", Dept. of Electrical Engineering, 1998 IEEE, May 18-21, 1998, pp. 1214-1218.

Makinen, J et al., "AMR-WB+: a New Audio Coding Standard for 3rd Generation Mobile Audio Services", 2005 IEEE International Conference on Acoustics, Speech, and Signal Processing. Philadelphia, PA, USA., Mar. 18, 2005, 1109-1112.

Motlicek, P et al., "Audio Coding Based on Long Temporal Contexts", Rapport de recherche de l'IDIAP 06-30, Apr. 2006, pp. 1-10.

Neuendorf, M et al., "A Novel Scheme for Low Bitrate Unified Speech Audio Coding—MPEG RMO", AES 126th Convention. Convention Paper 7713. Munich, Germany, May 1, 2009, 13 Pages.

Neuendorf, M et al., "Completion of Core Experiment on unification of USAC Windowing and Frame Transitions", International Organisation for Standardisation Organisation Internationale De Normalisation ISO/IEC JTC1/SC29/WG11. Coding of Moving Pictures and Audio. Kyoto, Japan., Jan. 2010, 52 Pages.

Neuendorf, M et al., "Unified Speech and Audio Coding Scheme for High Quality at Low Bitrates", ICASSP 2009 IEEE International Conference on Acoustics, Speech and Signal Processing. Piscataway, NJ, USA., Apr. 19, 2009, 4 Pages.

Patwardhan, P et al., "Effect of Voice Quality on Frequency-Warped Modeling of Vowel Spectra", Speech Communication. vol. 48, No. 8., Aug. 2006, pp. 1009-1023.

Ryan, D et al., "Reflected Simplex Codebooks for Limited Feedback MIMO Beamforming", IEEE. XP31506379A., Jun. 14-18, 2009, 6 Pages.

Sjoberg, J et al., "RTP Payload Format for the Extended Adaptive Multi-Rate Wideband (AMR-WB+) Audio Codec", Memo. The Internet Society. Network Working Group. Category: Standards Track., Jan. 2006, pp. 1-38.

Terriberry, T et al., "A Multiply-Free Enumeration of Combinations with Replacement and Sign", IEEE Signal Processing Letters. vol. 15, 2008, 11 Pages.

Terriberry, T et al., "Pulse Vector Coding", Retrieved from the internet on Oct. 12, 2012. XP55025946. URL:http://people.xiph.org/~tterribe/notes/cwrs.html, Dec. 1, 2007, 4 Pages.

Virette, D et al., "Enhanced Pulse Indexing CE for ACELP in USAC", Organisation Internationale De Normalisation ISO/IEC JTC1/SC29/WG11. MPEG2012/M19305. Coding of Moving Pictures and Audio. Daegu, Korea., Jan. 2011, 13 Pages.

Wang, F et al., "Frequency Domain Adaptive Postfiltering for Enhancement of Noisy Speech", Speech Communication 12. Elsevier Science Publishers. Amsterdam, North-Holland. vol. 12, No. 1., Mar. 1993, 41-56.

Waterschoot, T et al., "Comparison of Linear Prediction Models for Audio Signals", EURASIP Journal on Audio, Speech, and Music Processing. vol. 24., Dec. 2008, 27 pages.

Zernicki, T et al., "Report on CE on Improved Tonal Component Coding in eSBR", International Organisation for Standardisation Organisation Internationale De Normalisation ISO/IEC JTC1/SC29/WG11. Coding of Moving Pictures and Audio. Daegu, South Korea, Jan. 2011, 20 Pages.

A Silence Compression Scheme for G.729 Optimized for Terminals Conforming to Recommendation V.70", ITU-T Recommendation G.729—Annex B, International Telecommunication Union, Nov. 1996, pp. 1-16.

Martin, R., Spectral Subtraction Based on Minimum Statistics, Proceedings of European Signal Processing Conference (EUSIPCO), Edinburg, Scotland, Great Britain, Sep. 1994, pp. 1182-1185.

Lefebvre, R. et al., "High quality coding of wideband audio signals using transform coded excitation (TCX)", 1994 IEEE International Conference on Acoustics, Speech, and Signal Processing, Apr. 19-22, 1994, pp. 1/193-1/196 (4 pages).

3GPP, TS 26.290 Version 9.0.0; Digital cellular telecommunications system (Phase 2+); Universal Mobile Telecommunications System (UMTS); LTE; Audio codec processing functions; Extended Adaptive Multi-Rate-Wideband (AMR-WB+) codec; Transcoding functions (3GPP TS 26.290 version 9.0.0 release 9), Jan. 2010, Chapter 5.3, pp. 24-39.

(56) References Cited

OTHER PUBLICATIONS

Herley, C. et al., "Tilings of the Time-Frequency Plane: Construction of Arbitrary Orthogonal Bases and Fast Tilings Algorithms", IEEE Transactions on Signal Processing , vol. 41, No. 12, Dec. 1993, pp. 3341-3359.
Fuchs, et al., "MDCT-Based Coder for Highly Adaptive Speech and Audio Coding", 17th European Signal Processing Conference (EUSIPCO 2009), Glasgow, Scotland, Aug. 24-28, 2009, pp. 1264-1268.
Song, et al., "Research on Open Source Encoding Technology for MPEG Unified Speech and Audio Coding", Journal of the Institute of Electronics Engineers of Korea vol. 50 No. 1, Jan. 2013, pp. 86-96.

* cited by examiner

LINEAR PREDICTION BASED CODING SCHEME USING SPECTRAL DOMAIN NOISE SHAPING

CROSS-REFERENCE TO RELATED APPLICATIONS

This application is a continuation of copending International Application No. PCT/EP2012/052455, filed Feb. 14, 2012, which is incorporated herein by reference in its entirety, and additionally claims priority from U.S. Provisional Application No. 61/442,632, filed Feb. 14, 2011, which is also incorporated herein by reference in its entirety.

BACKGROUND OF THE INVENTION

The present invention is concerned with a linear prediction based audio codec using frequency domain noise shaping such as the TCX mode known from USAC.

As a relatively new audio codec, USAC has recently been finalized. USAC is a codec which supports switching between several coding modes such as an AAC like coding mode, a time-domain coding mode using linear prediction coding, namely ACELP, and transform coded excitation coding forming an intermediate coding mode according to which spectral domain shaping is controlled using the linear prediction coefficients transmitted via the data stream. In WO 2011147950, a proposal has been made to render the USAC coding scheme more suitable for low delay applications by excluding the AAC like coding mode from availability and restricting the coding modes to ACELP and TCX only. Further, it has been proposed to reduce the frame length.

However, it would be favorable to have a possibility at hand to reduce the complexity of a linear prediction based coding scheme using spectral domain shaping while achieving similar coding efficiency in terms of, for example, rate/distortion ratio sense.

Thus, it is an object of the present invention to provide such a linear prediction based coding scheme using spectral domain shaping allowing for a complexity reduction at a comparable or even increased coding efficiency.

SUMMARY

According to an embodiment, an audio encoder may have: a spectral decomposer for spectrally decomposing, using an MDCT, an audio input signal into a spectrogram of a sequence of spectrums; an autocorrelation computer configured to compute an autocorrelation from a current spectrum of the sequence of spectrums; a linear prediction coefficient computer configured to compute linear prediction coefficients based on the autocorrelation; a spectral domain shaper configured to spectrally shape the current spectrum based on the linear prediction coefficients; and a quantization stage configured to quantize the spectrally shaped spectrum; wherein the audio encoder is configured to insert information on the quantized spectrally shaped spectrum and information on the linear prediction coefficients into a data stream, and wherein the autocorrelation computer is configured to, in computing the autocorrelation from the current spectrum, compute the power spectrum from the current spectrum, and subject the power spectrum to an inverse ODFT transform.

According to another embodiment, an audio encoding method may have the steps of: spectrally decomposing, using an MDCT, an audio input signal into a spectrogram of a sequence of spectrums; computing an autocorrelation from a current spectrum of the sequence of spectrums; computing linear prediction coefficients based on the autocorrelation; spectrally shaping the current spectrum based on the linear prediction coefficients; quantizing the spectrally shaped spectrum; and inserting information on the quantized spectrally shaped spectrum and information on the linear prediction coefficients into a data stream, wherein the computation of the autocorrelation from the current spectrum, has computing the power spectrum from the current spectrum, and subjecting the power spectrum to an inverse ODFT transform.

Another embodiment may have a computer program having a program code for performing, when running on a computer, the above audio encoding method.

It is a basic idea underlying the present invention that an encoding concept which is linear prediction based and uses spectral domain noise shaping may be rendered less complex at a comparable coding efficiency in terms of, for example, rate/distortion ratio, if the spectral decomposition of the audio input signal into a spectrogram comprising a sequence of spectra is used for both linear prediction coefficient computation as well as the input for a spectral domain shaping based on the linear prediction coefficients.

In this regard, it has been found out that the coding efficiency remains even if such a lapped transform is used for the spectral decomposition which causes aliasing and necessitates time aliasing cancellation such as critically sampled lapped transforms such as an MDCT.

BRIEF DESCRIPTION OF THE DRAWINGS

Embodiments of the present application are described with respect to the figures, among which

DETAILED DESCRIPTION OF THE INVENTION

In order to ease the understanding of the main aspects and advantages of the embodiments of the present invention further described below, reference is preliminarily made to FIG. 1 which shows a linear prediction based audio encoder using spectral domain noise shaping.

Figure 1:
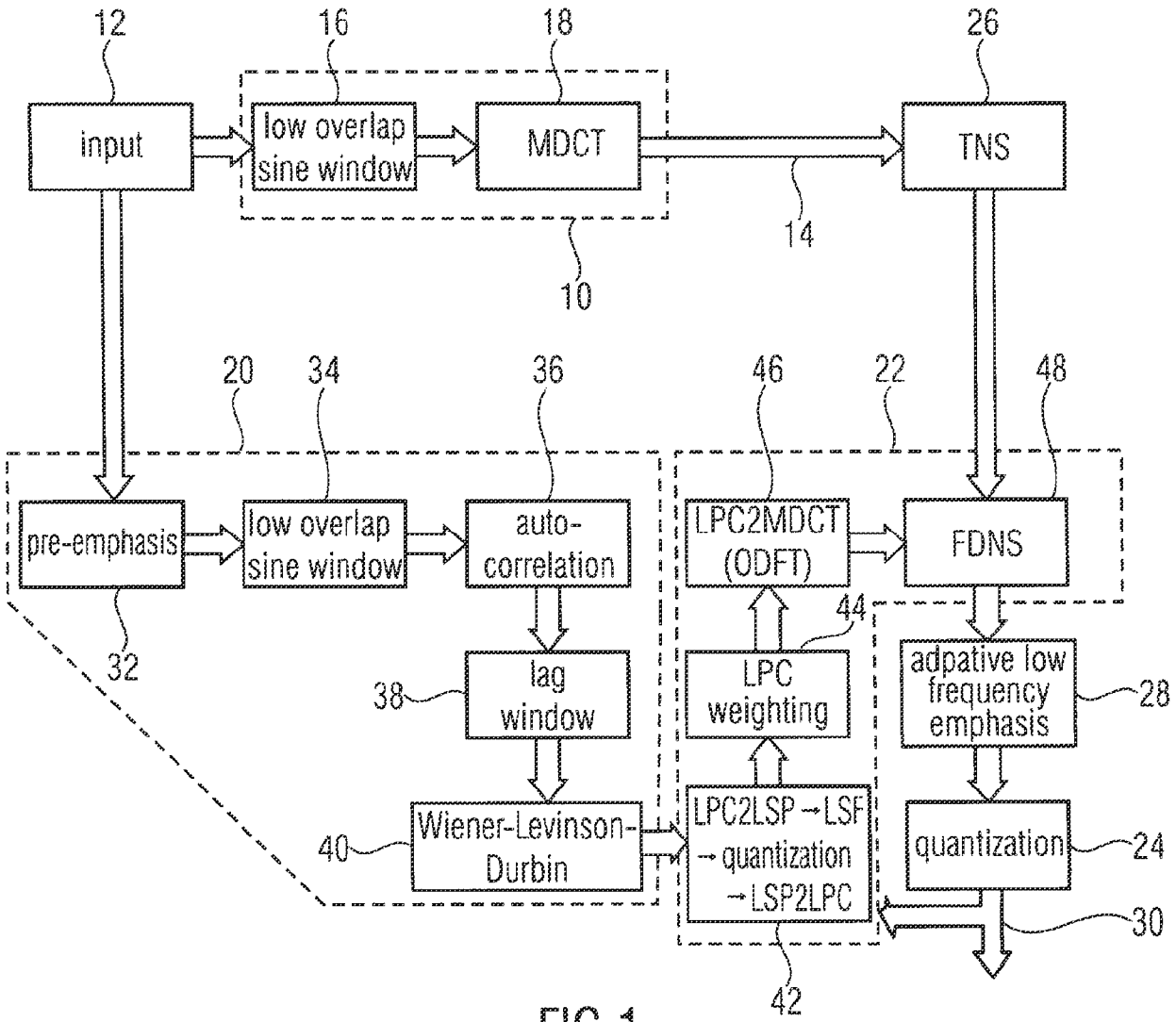
FIG. 1 shows a block diagram of an audio encoder in accordance with a comparison or embodiment.

In particular, the audio encoder of FIG. 1 comprises a spectral decomposer 10 for spectrally decomposing an input audio signal 12 into a spectrogram consisting of a sequence of spectra, which is indicated at 14 in FIG. 1. As is shown in FIG. 1, the spectral decomposer 10 may use an MDCT in order to transfer the input audio signal 10 from time domain to spectral domain. In particular, a windower 16 precedes the MDCT module 18 of the spectral decomposer 10 so as to window mutually overlapping portions of the input audio signal 12 which windowed portions are individually subject to the respective transform in the MDCT module 18 so as to obtain the spectra of the sequence of spectra of spectrogram 14. However, spectral decomposer 10 may, alternatively, use any other lapped transform causing aliasing such as any other critically sampled lapped transform.

Further, the audio encoder of FIG. 1 comprises a linear prediction analyzer 20 for analyzing the input audio signal 12 so as to derive linear prediction coefficients therefrom. A spectral domain shaper 22 of audio encoder of FIG. 1 is configured to spectrally shape a current spectrum of the sequence of spectra of spectrogram 14 based on the linear prediction coefficients provided by linear prediction analyzer 20. In particular, the spectral domain shaper 22 is configured to spectrally shape a current spectrum entering the spectral domain shaper 22 in accordance with a transfer function which corresponds to a linear prediction analysis filter transfer function by converting the linear prediction coefficients from analyzer 20 into spectral weighting values and applying the latter weighting values as divisors so as to spectrally form or shape the current spectrum. The shaped spectrum is subject to quantization in a quantizer 24 of audio encoder of FIG. 1. Due to the shaping in the spectral domain shaper 22, the quantization noise which results upon de-shaping the quantized spectrum at the decoder side, is shifted so as to be hidden, i.e. the coding is as perceptually transparent as possible.

For sake of completeness only, it is noted that a temporal noise shaping module 26 may optionally subject the spectra forwarded from spectral decomposer 10 to spectral domain shaper 22 to a temporal noise shaping, and a low frequency emphasis module 28 may adaptively filter each shaped spectrum output by spectral domain shaper 22 prior to quantization 24.

The quantized and spectrally shaped spectrum is inserted into the data stream 30 along with information on the linear prediction coefficients used in spectral shaping so that, at the decoding side, the de-shaping and de-quantization may be performed.

The most parts of the audio codec, one exception being the TNS module 26, shown in FIG. 1 are, for example, embodied and described in the new audio codec USAC and in particular, within the TCX mode thereof. Accordingly, for further details, reference is made, exemplarily, to the USAC standard, for example [1].

Nevertheless, more emphasis is provided in the following with regard to the linear prediction analyzer 20. As is shown in FIG. 1, the linear prediction analyzer 20 directly operates on the input audio signal 12. A pre-emphasis module 32 pre-filters the input audio signal 12 such as, for example, by FIR filtering, and thereinafter, an autocorrelation is continuously derived by a concatenation of a windower 34, autocorrelator 36 and lag windower 38. Windower 34 forms windowed portions out of the pre-filtered input audio signal which windowed portions may mutually overlap in time. Autocorrelator 36 computes an autocorrelation per windowed portion output by windower 34 and lag windower 38 is optionally provided to apply a lag window function onto the autocorrelations so as to render the autocorrelations more suitable for the following linear prediction parameter estimate algorithm. In particular, a linear prediction parameter estimator 40 receives the lag window output and performs, for example, a Wiener-Levinson-Durbin or other suitable algorithm onto the windowed autocorrelations so as to derive linear prediction coefficients per autocorrelation. Within the spectral domain shaper 22, the resulting linear prediction coefficients are passed through a chain of modules 42, 44, 46 and 48. The module 42 is responsible for transferring information on the linear prediction coefficients within the data stream 30 to the decoding side. As shown in FIG. 1, the linear prediction coefficient data stream inserter 42 may be configured to perform a quantization of the linear prediction coefficients determined by linear prediction analyzer 20 in a line spectral pair or line spectral frequency domain with coding the quantized coefficients into data stream 30 and re-converting the quantized prediction values into LPC coefficients again. Optionally, some interpolation may be used in order to reduce an update rate at which information onto the linear prediction coefficients is conveyed within data stream 30. Accordingly, the subsequent module 44 which is responsible for subjecting the linear prediction coefficients concerning the current spectrum entering the spectral domain shaper 22 to some weighting process, has access to linear prediction coefficients as they are also available at the decoding side, i.e. access to the quantized linear prediction coefficients. A subsequent module 46, converts the weighted linear prediction coefficients to spectral weightings which are then applied by the frequency domain noise shaper module 48 so as to spectrally shape the inbound current spectrum.

As became clear from the above discussion, the linear prediction analysis performed by analyzer 20 causes overhead which completely adds-up to the spectral decomposition and the spectral domain shaping performed in blocks 10 and 22 and accordingly, the computational overhead is considerable.

Figure 2:
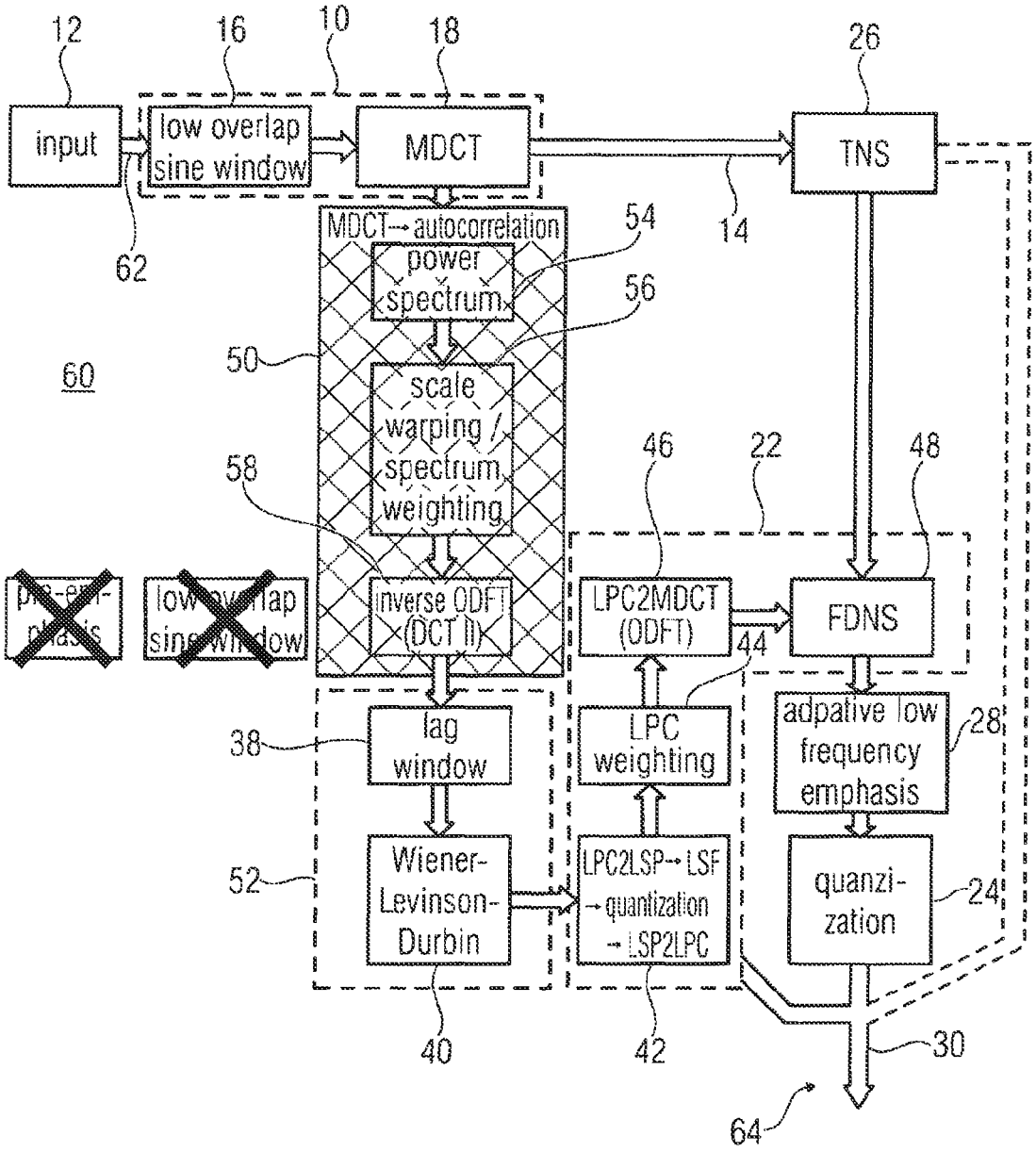
FIG. 2 shows an audio encoder in accordance with an embodiment of the present application.

FIG. 2 shows an audio encoder according to an embodiment of the present application which offers comparable coding efficiency, but has reduced coding complexity.

Briefly spoken, in the audio encoder of FIG. 2 which represents an embodiment of the present application, the linear prediction analyzer of FIG. 1 is replaced by a concatenation of an autocorrelation computer 50 and a linear prediction coefficient computer 52 serially connected between spectral decomposer 10 and spectral domain shaper 22. The motivation for the modification from FIG. 1 to FIG. 2 and the mathematical explanation which reveals the detailed functionality of modules 50 and 52 will be provided in the following. However, it is obvious that the computational overhead of the audio encoder of FIG. 2 is reduced compared to the audio encoder of FIG. 1 considering that the autocorrelation computer 50 involves less complex computations when compared to a sequence of computations involved with the autocorrelation and the windowing prior to the autocorrelation.

Before describing the detailed and mathematical framework of the embodiment of FIG. 2, the structure of the audio encoder of FIG. 2 is briefly described. In particular, the audio encoder of FIG. 2 which is generally indicated using reference sign 60 comprises an input 62 for receiving the input audio signal 12 and an output 64 for outputting the data stream 30 into which the audio encoder encodes the input audio signal 12. Spectral decomposer 10, temporal noise shaper 26, spectral domain shaper 22, low frequency emphasizer 28 and quantizer 24 are connected in series in the order of their mentioning between input 62 and output 64. Temporal noise shaper 26 and low frequency emphasizer 28 are optional modules and may, in accordance with an alternative embodiment, be left away. If present, the temporal noise shaper 26 may be configured to be activatable adaptively, i.e. the temporal noise shaping by temporal noise shaper 26 may be activated or deactivated depending on the input audio signal's characteristic, for example, with a result of the decision being, for example, transferred to the decoding side via data stream 30 as will be explained in more detail below.

As shown in FIG. 1, the spectral domain shaper 22 of FIG. 2 is internally constructed as it has been described with respect to FIG. 1. However, the internal structure of FIG. 2 is not to be interpreted as a critical issue and the internal structure of the spectral domain shaper 22 may also be different when compared to the exact structure shown in FIG. 2.

The linear prediction coefficient computer 52 of FIG. 2 comprises the lag windower 38 and the linear prediction coefficient estimator 40 which are serially connected between the autocorrelation computer 50 on the one hand and the spectral domain shaper 22 on the other hand. It should be noted that the lag windower, for example, is also an optional feature. If present, the window applied by lag windower 38 on the individual autocorrelations provided by autocorrelation computer 50 could be a Gaussian or binomial shaped window. With regard to the linear prediction coefficient estimator 40, it is noted that same not necessarily uses the Wiener-Levinson-Durbin algorithm. Rather, a different algorithm could be used in order to compute the linear prediction coefficients.

Internally, the autocorrelation computer 50 comprises a sequence of a power spectrum computer 54 followed by a scale warper/spectrum weighter 56 which in turn is followed by an inverse transformer 58. The details and significance of the sequence of modules 54 to 58 will be described in more detail below.

In order to understand as to why it is possible to co-use the spectral decomposition of decomposer 10 for both, spectral domain noise shaping within shaper 22 as well as linear prediction coefficient computation, one should consider the Wiener-Khinichin Theorem which shows that an autocorrelation can be calculated using a DFT:

$$R_m = \frac{1}{N}\sum_{k=0}^{N-1} S_k e^{\frac{2\pi i}{N}km}$$

$$m = 0, \ldots, N-1$$

where $$S_k = X_k X_k^*$$

$$X_k = \sum_{n=0}^{N-1} x_n e^{-\frac{2\pi i}{N}kn}$$

$$R_m = E(x_n x_{n-m}^*)$$

$$k = 0, \ldots, N-1$$

$$m = 0, \ldots, N-1$$

Thus, $R_m$ are the autocorrelation coefficients of the autocorrelation of the signal's portion $x_n$ of which the DFT is $X_k$.

Accordingly, if spectral decomposer 10 would use a DFT in order to implement the lapped transform and generate the sequence of spectra of the input audio signal 12, then autocorrelation calculator 50 would be able to perform a faster calculation of an autocorrelation at its output, merely by obeying the just outlined Wiener-Khinichin Theorem.

If the values for all lags m of the autocorrelation are necessitated, the DFT of the spectral decomposer 10 could be performed using an FFT and an inverse FFT could be used within the autocorrelation computer 50 so as to derive the autocorrelation therefrom using the just mentioned formula. When, however, only M<<N lags are needed, it would be faster to use an FFT for the spectral decomposition and directly apply an inverse DFT so as to obtain the relevant autocorrelation coefficients.

The same holds true when the DFT mentioned above is replaced with an ODFT, i.e. odd frequency DFT, where a generalized DFT of a time sequence x is defined as:

$$X_k^{odft} = \sum_{n=0}^{N-1} x_n e^{-\frac{2\pi i}{N(k+b)(n+a)}}$$

$$k = 0, \ldots, N-1$$

and $$a = 0$$

$$b = \frac{1}{2}$$

is set for ODFT (Odd Frequency DFT).

If, however, an MDCT is used in the embodiment of FIG. 2, rather than a DFT or FFT, things differ. The MDCT involves a discrete cosine transform of type IV and only reveals a real-valued spectrum. That is, phase information gets lost by this transformation. The MDCT can be written as:

$$X_k = \sum_{n=0}^{2N-1} x_n \cos\left[\frac{\pi}{N}\left(n + \frac{1}{2} + \frac{N}{2}\right)\left(k + \frac{1}{2}\right)\right]$$

$$k = 0, \ldots, N-1$$

where $x_n$ with n=0 . . . 2N−1 defines a current windowed portion of the input audio signal 12 as output by windower 16 and $X_k$ is, accordingly, the k-th spectral coefficient of the resulting spectrum for this windowed portion.

The power spectrum computer 54 calculates from the output of the MDCT the power spectrum by squaring each transform coefficient $X_k$ according to:

$$S_k = |X_k|^2 \quad k = 0, \ldots, N-1$$

The relation between an MDCT spectrum as defined by $X_k$ and an ODFT spectrum $X_k^{ODFT}$ can be written as:

$$X_k = \mathrm{Re}\left(X_k^{odft}\right)\cos(\theta_k) + \mathrm{Im}\left(X_k^{odft}\right)\sin(\theta_k)$$

$$k = 0, \ldots, N-1$$

$$\theta_k = \frac{\pi}{N}\left(\frac{1}{2} + \frac{N}{2}\right)\left(k + \frac{1}{2}\right)$$

$$|X_k| = \left|X_k^{odft}\right|\left|\cos\left[\arg\left(X_k^{odft}\right) - \theta_k\right]\right|$$

This means that using the MDCT instead of an ODFT as input for the autocorrelation computer 50 performing the MDCT to autocorrelation procedure, is equivalent to the autocorrelation obtained from the ODFT with a spectrum weighting of $$f_k^{mdct} = |\cos\left[\arg(X_k^{odft}) - \theta_k\right]|$$

This distortion of the autocorrelation determined is, however, transparent for the decoding side as the spectral domain shaping within shaper 22 takes place in exactly the same spectral domain as the one of the spectral decomposer 10, namely the MDCT. In other words, since the frequency domain noise shaping by frequency domain noise shaper 48 of FIG. 2 is applied in the MDCT domain, this effectively means that the spectrum weighting $f_k^{mdct}$ cancels out the modulation of the MDCT and produces similar results as a conventional LPC as shown in FIG. 1 would produce when the MDCT would be replaced with an ODFT.

Accordingly, in the autocorrelation computer 50, the inverse transformer 58 performs an inverse ODFT and an inverse ODFT of a symmetrical real input is equal to a DCT type II:

$$X_k = \sum_{n=0}^{N-1} x_n \cos\left[\frac{\pi}{N}\left(n + \frac{1}{2}\right)k\right]$$

Thus, this allows a fast computation of the MDCT based LPC in the autocorrelation computer 50 of FIG. 2, as the autocorrelation as determined by the inverse ODFT at the output of inverse transformer 58 comes at a relatively low computational cost as merely minor computational steps are necessitated such as the just outlined squaring and the power spectrum computer 54 and the inverse ODFT in the inverse transformer 58.

Details regarding the scale warper/spectrum weighter 56 have not yet been described. In particular, this module is optional and may be left away or replaced by a frequency domain decimator. Details regarding possible measures performed by module 56 are described in the following. Before that, however, some details regarding some of the other elements shown in FIG. 2 are outlined. Regarding the lag windower 38, for example, it is noted that same may perform a white noise compensation in order to improve the conditioning of the linear prediction coefficient estimation performed by estimator 40. The LPC weighting performed in module 44 is optional, but if present, it may be performed so as to achieve an actual bandwidth expansion. That is, poles of the LPCs are moved toward the origin by a constant factor according to, for example, $$A'(z) = A\left(\frac{z}{\gamma}\right)$$

Thus, the LPC weighting thus performed approximates the simultaneous masking. A constant of $\gamma$=0.92 or somewhere between 0.85 and 0.95, both inclusively, produces good results.

Regarding module 42 it is noted that variable bitrate coding or some other entropy coding scheme may be used in order to encode the information concerning the linear prediction coefficients into the data stream 30. As already mentioned above, the quantization could be performed in the LSP/LSF domain, but the ISP/ISF domain is also feasible.

Regarding the LPC-to-MDCT module 46 which converts the LPC into spectral weighting values which are called, in case of MDCT domain, MDCT gains in the following, reference is made, for example, to the USAC codec where this transform is explained in detail. Briefly spoken, the LPC coefficients may be subject to an ODFT so as to obtain MDCT gains, the inverse of which may then be used as weightings for shaping the spectrum in module 48 by applying the resulting weightings onto respective bands of the spectrum. For example, 16 LPC coefficients are converted into MDCT gains. Naturally, instead of weighting using the inverse, weighting using the MDCT gains in non-inverted form is used at the decoder side in order to obtain a transfer function resembling an LPC synthesis filter so as to form the quantization noise as already mentioned above. Thus, summarizing, in module 46, the gains used by the FDNS 48 are obtained from the linear prediction coefficients using an ODFT and are called MDCT gains in case of using MDCT.

Figure 3:
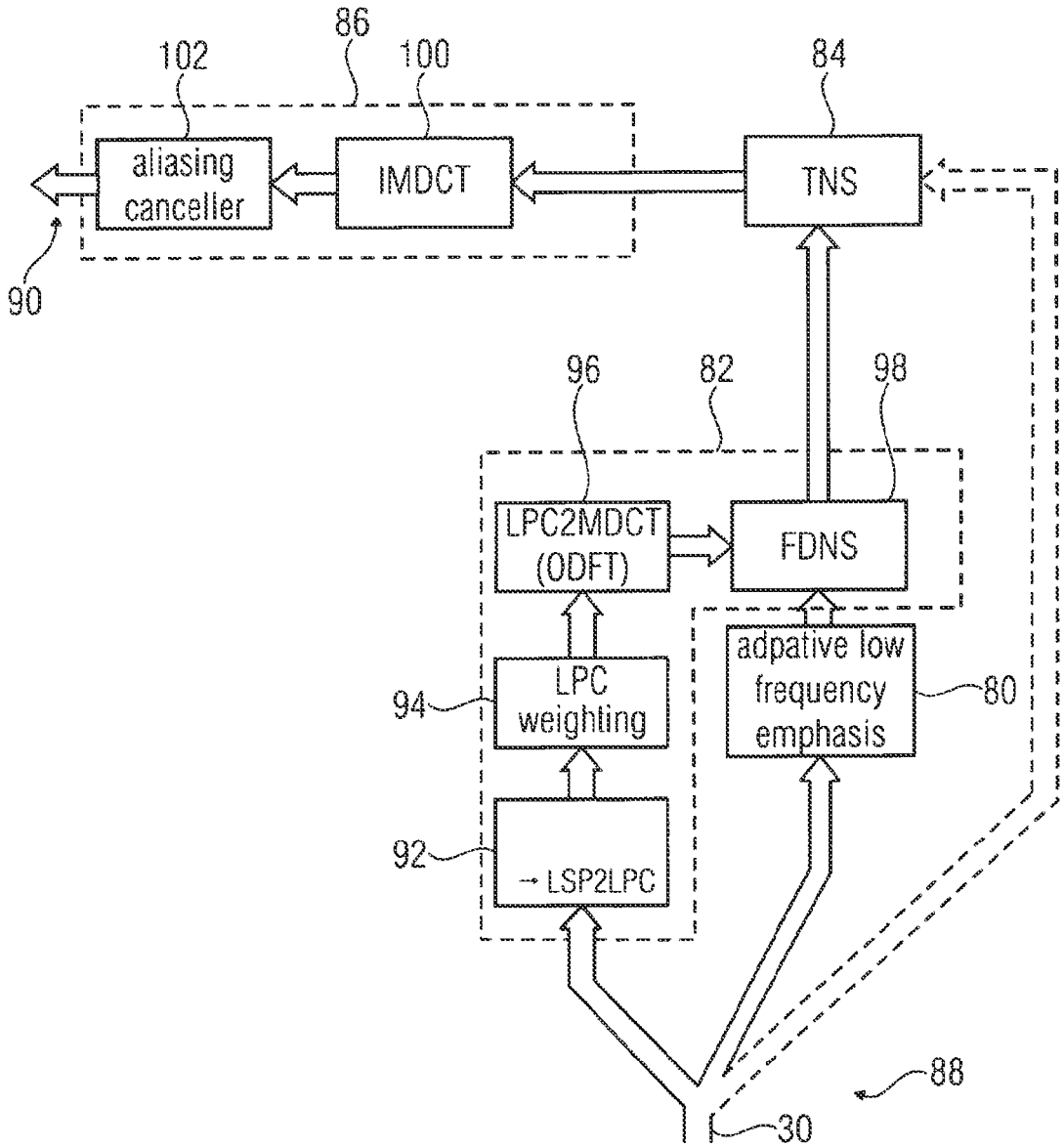
FIG. 3 shows a block diagram of a possible audio decoder fitting to the audio encoder of FIG. 2.

For sake of completeness, FIG. 3 shows a possible implementation for an audio decoder which could be used in order to reconstruct the audio signal from the data stream 30 again. The decoder of FIG. 3 comprises a low frequency de-emphasizer 80, which is optional, a spectral domain deshaper 82, a temporal noise deshaper 84, which is also optional, and a spectral-to-time domain converter 86, which are serially connected between a data stream input 88 of the audio decoder at which the data stream 30 enters, and an output 90 of the audio decoder where the reconstructed audio signal is output. The low frequency de-emphasizer receives from the data stream 30 the quantized and spectrally shaped spectrum and performs a filtering thereon, which is inverse to the low frequency emphasizer's transfer function of FIG. 2. As already mentioned, de-emphasizer 80 is, however, optional.

The spectral domain deshaper 82 has a structure which is very similar to that of the spectral domain shaper 22 of FIG. 2. In particular, internally same comprises a concatenation of LPC extractor 92, LPC weighter 94, which is equal to LPC weighter 44, an LPC to MDCT converter 96, which is also equal to module 46 of FIG. 2, and a frequency domain noise shaper 98 which applies the MDCT gains onto the inbound (de-emphasized) spectrum inversely to FDNS 48 of FIG. 2, i.e. by multiplication rather than division in order to obtain a transfer function which corresponds to a linear prediction synthesis filter of the linear prediction coefficients extracted from the data stream 30 by LPC extractor 92. The LPC extractor 92 may perform the above mentioned retransform from a corresponding quantization domain such as LSP/LSF or ISP/ISF to obtain the linear prediction coefficients for the individual spectrums coded into data stream 30 for the consecutive mutually overlapping portions of the audio signal to be reconstructed.

The time domain noise shaper 84 reverses the filtering of module 26 of FIG. 2, and possible implementations for these modules are described in more detail below. In any case, however, TNS module 84 of FIG. 3 is optional and may be left away as has also been mentioned with regard to TNS module 26 of FIG. 2.

The spectral composer 86 comprises, internally, an inverse transformer 100 performing, for example, an IMDCT individually onto the inbound de-shaped spectra, followed by an aliasing canceller such as an overlap-add adder 102 configured to correctly temporally register the reconstructed windowed versions output by retransformer 100 so as to perform time aliasing cancellation between same and to output the reconstructed audio signal at output 90.

As already mentioned above, due to the spectral domain shaping 22 in accordance with a transfer function corresponding to an LPC analysis filter defined by the LPC coefficients conveyed within data stream 30, the quantization in quantizer 24, which has, for example, a spectrally flat noise, is shaped by the spectral domain deshaper 82 at a decoding side in a manner so as to be hidden below the masking threshold.

Different possibilities exist for implementing the TNS module 26 and the inverse thereof in the decoder, namely module 84. Temporal noise shaping is for shaping the noise in the temporal sense within the time portions which the individual spectra spectrally formed by the spectral domain shaper referred to. Temporal noise shaping is especially useful in case of transients being present within the respective time portion the current spectrum refers to. In accordance with a specific embodiment, the temporal noise shaper 26 is configured as a spectrum predictor configured to predictively filter the current spectrum or the sequence of spectra output by the spectral decomposer 10 along a spectral dimension. That is, spectrum predictor 26 may also determine prediction filter coefficients which may be inserted into the data stream 30. This is illustrated by a dashed line in FIG. 2. As a consequence, the temporal noise filtered spectra are flattened along the spectral dimension and owing to the relationship between spectral domain and time domain, the inverse filtering within the time domain noise deshaper 84 in accordance with the transmitted time domain noise shaping prediction filters within data stream 30, the deshaping leads to a hiding or compressing of the noise within the times or time at which the attack or transients occur. So called pre-echoes are thereby avoided.

In other words, by predictively filtering the current spectrum in time domain noise shaper 26, the time domain noise shaper 26 obtains as spectrum reminder, i.e. the predictively filtered spectrum which is forwarded to the spectral domain shaper 22, wherein the corresponding prediction coefficients are inserted into the data stream 30. The time domain noise deshaper 84, in turn, receives from the spectral domain deshaper 82 the de-shaped spectrum and reverses the time domain filtering along the spectral domain by inversely filtering this spectrum in accordance with the prediction filters received from data stream, or extracted from data stream 30. In other words, time domain noise shaper 26 uses an analysis prediction filter such as a linear prediction filter, whereas the time domain noise deshaper 84 uses a corresponding synthesis filter based on the same prediction coefficients.

As already mentioned, the audio encoder may be configured to decide to enable or disable the temporal-noise shaping depending on the filter prediction gain or a tonality or transiency of the audio input signal 12 at the respective time portion corresponding to the current spectrum. Again, the respective information on the decision is inserted into the data stream 30.

In the following, the possibility is discussed according to which the autocorrelation computer 50 is configured to compute the autocorrelation from the predictively filtered, i.e. TNS-filtered, version of the spectrum rather than the unfiltered spectrum as shown in FIG. 2. Two possibilities exist: the TNS-filtered spectrums may be used whenever TNS is applied, or in a manner chosen by the audio encoder based on, for example, characteristics of the input audio signal 12 to be encoded. Accordingly, the audio encoder of FIG. 4 differs from the audio encoder of FIG. 2 in that the input of the autocorrelation computer 50 is connected to both the output of the spectral decomposer 10 as well as the output of the TNS module 26.

As just mentioned, the TNS-filtered MDCT spectrum as output by spectral decomposer 10 can be used as an input or basis for the autocorrelation computation within computer 50. As just mentioned, the TNS-filtered spectrum could be used whenever TNS is applied, or the audio encoder could decide for spectra to which TNS was applied between using the unfiltered spectrum or the TNS-filtered spectrum. The decision could be made, as mentioned above, depending on the audio input signal's characteristics. The decision could be, however, transparent for the decoder, which merely applies the LPC coefficient information for the frequency domain deshaping. Another possibility would be that the audio encoder switches between the TNS-filtered spectrum and the non-filtered spectrum for spectrums to which TNS was applied, i.e. to make the decision between these two options for these spectrums, depending on a chosen transform length of the spectral decomposer 10.

Figure 4:
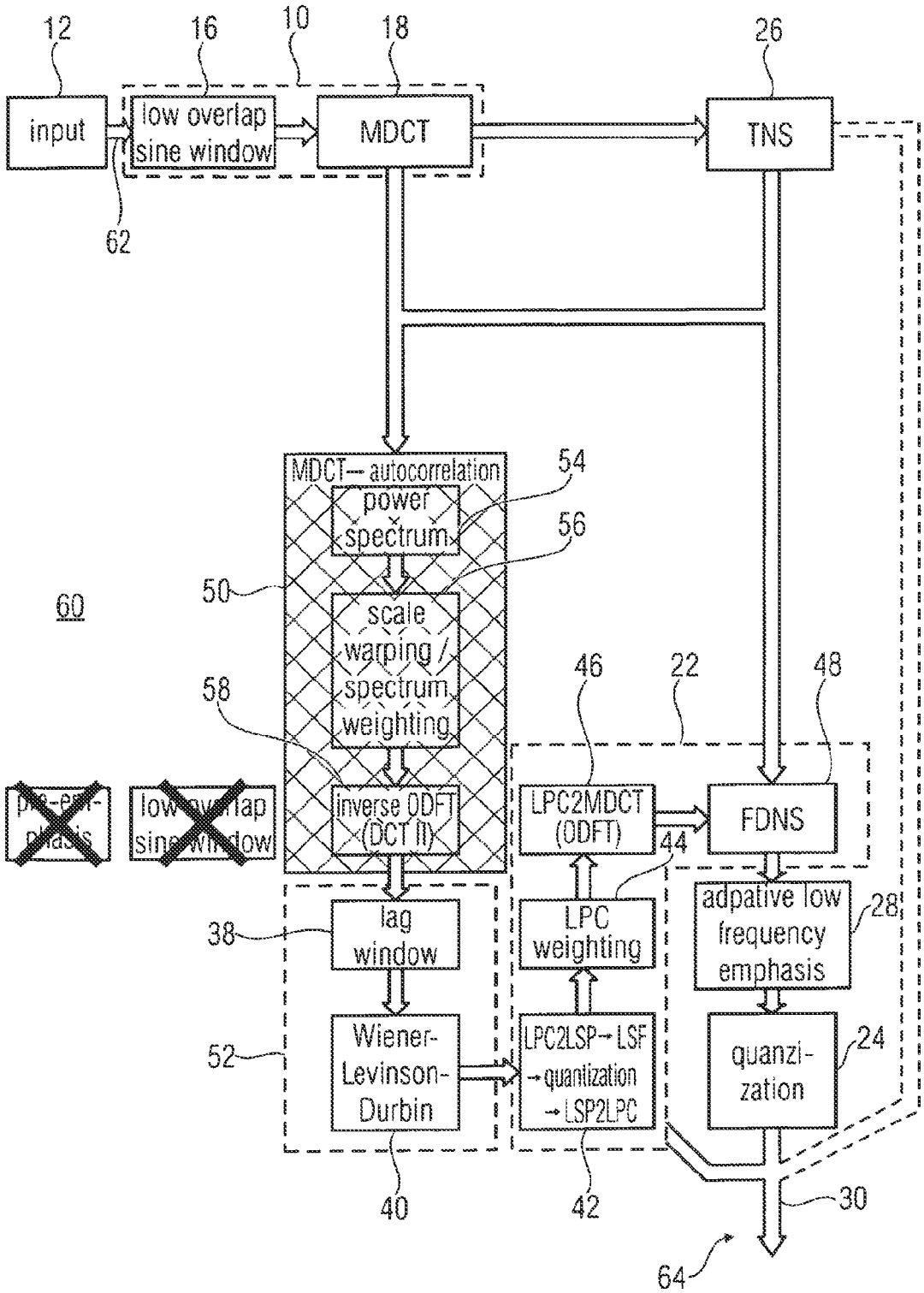
FIG. 4 shows a block diagram of an alternative audio encoder in accordance with an embodiment of the present application.

To be more precise, the decomposer 10 in FIG. 4 may be configured to switch between different transform lengths in spectrally decomposing the audio input signal so that the spectra output by the spectral decomposer 10 would be of different spectral resolution. That is, spectral decomposer 10 would, for example, use a lapped transform such as the MDCT, in order to transform mutually overlapping time portions of different length onto transforms or spectrums of also varying length, with the transform length of the spectra corresponding to the length of the corresponding overlapping time portions. In that case, the autocorrelation computer 50 could be configured to compute the autocorrelation from the predictively filtered or TNS-filtered current spectrum in case of a spectral resolution of the current spectrum fulfilling a predetermined criterion, or from the not predictively filtered, i.e. unfiltered, current spectrum in case of the spectral resolution of the current spectrum not fulfilling the predetermined criterion. The predetermined criterion could be, for example, that the current spectrum's spectral resolution exceeds some threshold. For example, using the TNS-filtered spectrum as output by TNS module 26 for the autocorrelation computation is beneficial for longer frames (time portions) such as frames longer than 15 ms, but may be disadvantageous for short frames (temporal portions) being shorter than, for example, 15 ms, and accordingly, the input into the autocorrelation computer 50 for longer frames may be the TNS-filtered MDCT spectrum, whereas for shorter frames the MDCT spectrum as output by decomposer 10 may be used directly.

Until now it has not yet been described which perceptual relevant modifications could be performed onto the power spectrum within module 56. Now, various measures are explained, and they could be applied individually or in combination onto all embodiments and variants described so far. In particular, a spectrum weighting could be applied by module 56 onto the power spectrum output by power spectrum computer 54. The spectrum weighting could be:

$$S_k' = f_k^2 S_k \quad k=0, \ldots, N-1$$

wherein $S_k$ are the coefficients of the power spectrum as already mentioned above.

Spectral weighting can be used as a mechanism for distributing the quantization noise in accordance with psychoacoustical aspects. Spectrum weighting corresponding to a pre-emphasis in the sense of FIG. 1 could be defined by:

$$f_k^{emph} = \sqrt{1 + \mu^2 - 2\mu\cos\left(\frac{k\pi}{N}\right)}$$

Moreover, scale warping could be used within module 56. The full spectrum could be divided, for example, into M bands for spectrums corresponding to frames or time portions of a sample length of $l_1$ and 2M bands for spectrums corresponding to time portions of frames having a sample length of $l_2$, wherein $l_2$ may be two times $l_1$, wherein $l_1$ may be 64, 128 or 256. In particular, the division could obey:

$$E_m = \sum_{k=l_m}^{l_{m+1}-1} S_k$$

-continued $$m = 0, \ldots, M-1$$

The band division could include frequency warping to an approximation of the Bark scale according to:

$$l_m \approx \frac{NF_s}{2Bark2Freq\left[m\frac{Freq2BBark\left(\frac{F_s}{2}\right)}{M}\right]}$$

alternatively the bands could be equally distributed to form a linear scale according to:

$$l_m = m\frac{N}{M}$$

For the spectrums of frames of length $l_1$, for example, a number of bands could be between 20 and 40, and between 48 and 72 for spectrums belonging to frames of length $l_2$, wherein 32 bands for spectrums of frames of length and 64 bands for spectrums of frames of length $l_2$ are of advantage.

Spectral weighting and frequency warping as optionally performed by optional module 56 could be regarded as a means of bit allocation (quantization noise shaping). Spectrum weighting in a linear scale corresponding to the pre-emphasis could be performed using a constant $\mu$=0.9 or a constant lying somewhere between 0.8 and 0.95, so that the corresponding pre-emphasis would approximately correspond to Bark scale warping.

Modification of the power spectrum within module 56 may include spreading of the power spectrum, modeling the simultaneous masking, and thus replace the LPC Weighting modules 44 and 94.

If a linear scale is used and the spectrum weighting corresponding to the pre-emphasis is applied, then the results of the audio encoder of FIG. 4 as obtained at the decoding side, i.e. at the output of the audio decoder of FIG. 3, are perceptually very similar to the conventional reconstruction result as obtained in accordance with the embodiment of FIG. 1.

Some listening test results have been performed using the embodiments identified above. From the tests, it turned out that the conventional LPC analysis as shown in FIG. 1 and the linear scale MDCT based LPC analysis produced perceptually equivalent results when

- The spectrum weighting in the MDCT based LPC analysis corresponds to the pre-emphasis in the conventional LPC analysis,
- The same windowing is used within the spectral decomposition, such as a low overlap sine window, and
- The linear scale is used in the MDCT based LPC analysis.

The negligible difference between the conventional LPC analysis and the linear scale MDCT based LPC analysis probably comes from the fact that the LPC is used for the quantization noise shaping and that there are enough bits at 48 kbits to code MDCT coefficients precisely enough.

Further, it turned out that using the Bark scale or non-linear scale by applying scale warping within module 56 results in coding efficiency or listening test results according to which the Bark scale outperforms the linear scale for the test audio pieces Applause, Fatboy, RockYou, Waiting, bohemian, fuguepremikres, kraftwerk, lesvoleurs, teardrop. The Bark scale fails miserably for hockey and linchpin. Another item that has problems in the Bark scale is bibilolo, but it wasn't included in the test as it presents an experimental music with specific spectrum structure. Some listeners also expressed strong dislike of the bibilolo item.

However, it is possible for the audio encoder of FIGS. 2 and 4 to switch between different scales. That is, module 56 could apply different scaling for different spectrums in dependency on the audio signal's characteristics such as the transiency or tonality or use different frequency scales to produce multiple quantized signals and a measure to determine which of the quantized signals is perceptually the best. It turned out that scale switching results in improvements in the presence of transients such as the transients in RockYou and linchpin when compared to both non-switched versions (Bark and linear scale).

It should be mentioned that the above outlined embodiments could be used as the TCX mode in a multi-mode audio codec such as a codec supporting ACELP and the above outlined embodiment as a TCX-like mode. As a framing, frames of a constant length such as 20 ms could be used. In this way, a kind of low delay version of the USAC codec could be obtained which is very efficient. As the TNS, the TNS from AAC-ELD could be used. To reduce the number of bits used for side information, the number of filters could be fixed to two, one operating from 600 Hz to 4500 Hz and a second from 4500 Hz to the end of the core coder spectrum. The filters could be independently switched on and off. The filters could be applied and transmitted as a lattice using parcor coefficients. The maximum order of a filter could be set to be eight and four bits could be used per filter coefficient. Huffman coding could be used to reduce the number of bits used for the order of a filter and for its coefficients.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1]: USAC codec (Unified Speech and Audio Codec), ISO/IEC CD 23003-3 dated Sep. 24, 2010

The invention claimed is:

1. An audio encoder comprising:

a spectral decomposer for spectrally decomposing, using a modified discrete cosine transformation, an audio input signal into a spectrogram of a sequence of spectrums;

an autocorrelation computer configured to compute an autocorrelation from a current spectrum of the sequence of spectrums;

a linear prediction coefficient computer configured to compute linear prediction coefficients based on the autocorrelation;

a spectral domain shaper configured to spectrally shape the current spectrum based on the linear prediction coefficients; and a quantization stage configured to quantize the spectrally shaped spectrum;

wherein the audio encoder is configured to insert information on the quantized spectrally shaped spectrum and information on the linear prediction coefficients into a data stream, and wherein the autocorrelation computer is configured to, in computing the autocorrelation from the current spectrum, compute the power spectrum from the current spectrum, and subject the power spectrum to an inverse odd frequency discrete fourier transform, wherein the audio encoder further comprises:

a spectrum predictor configured to predictively filter the current spectrum along a spectral dimension, wherein the spectral domain shaper is configured to spectrally shape the predictively filtered current spectrum, and the audio encoder is configured to insert information on how to reverse the predictive filtering into the data stream.

2. The audio encoder according to claim 1, wherein the spectrum predictor is configured to perform linear prediction filtering on the current spectrum along the spectral dimension, wherein the audio encoder is configured such that the information on how to reverse the predictive filtering comprises information on further linear prediction coefficients underlying the linear prediction filtering on the current spectrum along the spectral dimension.

3. The audio encoder according to claim 1, wherein the audio encoder is configured to decide to enable or disable the spectrum predictor depending on a tonality or transiency of the audio input signal or a filter prediction gain, wherein the audio encoder is configured to insert information on the decision.

4. The audio encoder according to claim 1, wherein the autocorrelation computer is configured to compute the autocorrelation from the predictively filtered current spectrum.

5. The audio encoder according to claim 1, wherein:

the spectral decomposer is configured to switch between different transform lengths in spectrally decomposing the audio input signal so that the spectrums are of different spectral resolution, wherein the autocorrelation computer is configured to compute the autocorrelation from the predictively filtered current spectrum in case of a spectral resolution of the current spectrum fulfilling a predetermined criterion, or from the not predictively filtered current spectrum in case of the spectral resolution of the current spectrum not fulfilling the predetermined criterion.

6. The audio encoder according to claim 5, wherein the autocorrelation computer is configured such that the predetermined criterion is fulfilled if the spectral resolution of the current spectrum is higher than a spectral resolution threshold.

7. An audio encoder comprising:

a spectral decomposer for spectrally decomposing, using a modified discrete cosine transformation, an audio input signal into a spectrogram of a sequence of spectrums;

an autocorrelation computer configured to compute an autocorrelation from a current spectrum of the sequence of spectrums;

a linear prediction coefficient computer configured to compute linear prediction coefficients based on the autocorrelation;

a spectral domain shaper configured to spectrally shape the current spectrum based on the linear prediction coefficients; and a quantization stage configured to quantize the spectrally shaped spectrum;

wherein the audio encoder is configured to insert information on the quantized spectrally shaped spectrum and information on the linear prediction coefficients into a data stream, and wherein the autocorrelation computer is configured to, in computing the autocorrelation from the current spectrum, compute the power spectrum from the current spectrum, and subject the power spectrum to an inverse odd frequency discrete fourier transform, wherein the autocorrelation computer is configured to, in computing the autocorrelation from the current spectrum, perceptually weight the power spectrum and subject the power spectrum to the inverse odd frequency discrete fourier transform as perceptually weighted.

8. The audio encoder according to claim 7, wherein the autocorrelation computer is configured to change a frequency scale of the current spectrum and to perform the perceptual weighting of the power spectrum in the changed frequency scale.

9. The audio encoder according to claim 7, wherein the audio encoder is configured to insert the information on the linear prediction coefficients into the data stream in a quantized form, wherein the spectral domain shaper is configured to spectrally shape the current spectrum based on the quantized linear prediction coefficients.

10. The audio encoder according to claim 9, wherein the audio encoder is configured to insert the information on the linear prediction coefficients into the data stream in a form according to which quantization of the linear prediction coefficients takes place in the LSF or LSP domain.

11. An audio encoding method comprising:

spectrally decomposing, using a modified discrete cosine transformation, an audio input signal into a spectrogram of a sequence of spectrums;

computing an autocorrelation from a current spectrum of the sequence of spectrums;

computing linear prediction coefficients based on the autocorrelation;

spectrally shaping the current spectrum based on the linear prediction coefficients;

quantizing the spectrally shaped spectrum; and inserting information on the quantized spectrally shaped spectrum and information on the linear prediction coefficients into a data stream, wherein the computation of the autocorrelation from the current spectrum, comprises computing the power spectrum from the current spectrum, and subjecting the power spectrum to an inverse odd frequency discrete fourier transform, wherein the audio encoding method further comprises predictively filtering the current spectrum along a spectral dimension by spectrally shaping the predictively filtered current spectrum, and inserting information on how to reverse the predictive filtering into the data stream.

12. A non-transitory computer readable medium having stored thereon a computer program comprising a program code for performing, when running on a computer, a method according to claim 11.

13. An audio encoding method comprising:

spectrally decomposing, using a modified discrete cosine transformation, an audio input signal into a spectrogram of a sequence of spectrums;

computing an autocorrelation from a current spectrum of the sequence of spectrums;

computing linear prediction coefficients based on the autocorrelation;

spectrally shaping the current spectrum based on the linear prediction coefficients;

quantizing the spectrally shaped spectrum; and inserting information on the quantized spectrally shaped spectrum and information on the linear prediction coefficients into a data stream, wherein the computation of the autocorrelation from the current spectrum, comprises computing the power spectrum from the current spectrum, and subjecting the power spectrum to an inverse odd frequency discrete fourier transform, wherein the computing the autocorrelation from the current spectrum comprises perceptually weighting the power spectrum and subjecting the power spectrum to the inverse odd frequency discrete fourier transform as perceptually weighted.

* * * * *